US007114188B1

(12) United States Patent
Teigen

(10) Patent No.: US 7,114,188 B1
(45) Date of Patent: Oct. 3, 2006

(54) STABILIZED KNEE PAD

(75) Inventor: James D. Teigen, Abilene, TX (US)

(73) Assignee: OK-1 Manufacturing Company, Altus, OK (US)

( * ) Notice: Subject to any disclaimer, the term of this patent is extended or adjusted under 35 U.S.C. 154(b) by 0 days.

(21) Appl. No.: 10/913,661

(22) Filed: Aug. 6, 2004

Related U.S. Application Data

(60) Provisional application No. 60/493,016, filed on Aug. 6, 2003.

(51) Int. Cl.
*A41D 13/00* (2006.01)

(52) U.S. Cl. ..... 2/24

(58) Field of Classification Search ..... 2/16, 2/24, 22, 455, 242, 267, 911, DIG. 3; 128/878, 128/881, 882; 602/20, 23, 25–27, 62–63, 602/65

See application file for complete search history.

(56) References Cited

U.S. PATENT DOCUMENTS 1,486,308 A * 3/1924 Shook ..... 2/24
2,195,817 A * 4/1940 Johnson ..... 2/24
2,363,058 A * 11/1944 Gill ..... 2/24
5,594,954 A * 1/1997 Huang ..... 2/24
5,727,252 A * 3/1998 Oetting et al. ..... 2/24
6,029,273 A * 2/2000 McCrane ..... 2/24
6,058,505 A 5/2000 Bettencourt
6,401,245 B1 6/2002 Slautterback
6,584,616 B1 7/2003 Godshaw et al.
6,820,279 B1 * 11/2004 Lesosky ..... 2/24

* cited by examiner

*Primary Examiner*—Tejash Patel
(74) *Attorney, Agent, or Firm*—Crowe & Dunlevy, P.C.

(57) ABSTRACT

Disclosed is a knee pad that is configured to properly stabilize a wearer's patella. The knee pad preferably includes a body that has a generally convex outer surface and a generally concave inner surface. A patella stabilizer is preferably positioned on the inner surface of the body of the knee pad. In combination with the body of the knee pad, the patella stabilizer prevents the displacement of the wearer's patella during use.

17 Claims, 5 Drawing Sheets

STABILIZED KNEE PAD

RELATED APPLICATIONS

This application claims the benefit of U.S. Provisional Patent Application No. 60/493,016 filed Aug. 6, 2003 entitled Stabilized Knee Pad, the disclosure of which is herein incorporated by reference.

FIELD OF THE INVENTION

The present invention generally relates to the field of protective garments and more particularly relates to improved knee pad designs.

BACKGROUND OF THE INVENTION

For many years, knee pads have been used in industrial, athletic and orthopedic applications to protect the wearer's knee from hard surfaces, impact or uncontrolled movement. With developments in orthopedic medicine, the causes of certain types of knee injury have become better recognized. It is also clear that many existing knee pads are incapable of properly protecting the knee during various activities. In some cases, improper knee pads can actually exacerbate injury and increase recovery time. The dislocation of the patella and associated soft tissue damage can be a common knee injury often attributable to inadequate knee protection.

For example, existing industrial knee pad designs fail to adequately stabilize the knee of the wearer during use. Traditional knee pads are constructed from a rigid pad that is held onto the wearer's knee with suitable straps. The interior of the knee pad fails to provide a contoured surface that will ergonomically support the kneecap. During use, the wearer's patella is permitted to laterally displace within the interior portion of the knee pad.

With increased focus on providing safe work environments, it is critically important to provide a properly designed knee pad that stabilizes and supports the wearer's patella during use. It is to these and other deficiencies in the prior art that the present invention is directed.

SUMMARY OF THE INVENTION

In a preferred embodiment, the present invention includes a knee pad that is configured to ergonomically stabilize a user's patella. The knee pad preferably includes a body that has a generally convex outer surface and a generally concave inner surface. The knee pad optionally includes a cap attached to the outer surface of the body of the knee pad. A patella stabilizer is preferably positioned on the inner surface of the body of the knee pad to prevent the displacement of the wearer's patella during use.

DETAILED DESCRIPTION OF THE PREFERRED EMBODIMENT

Figure 1:
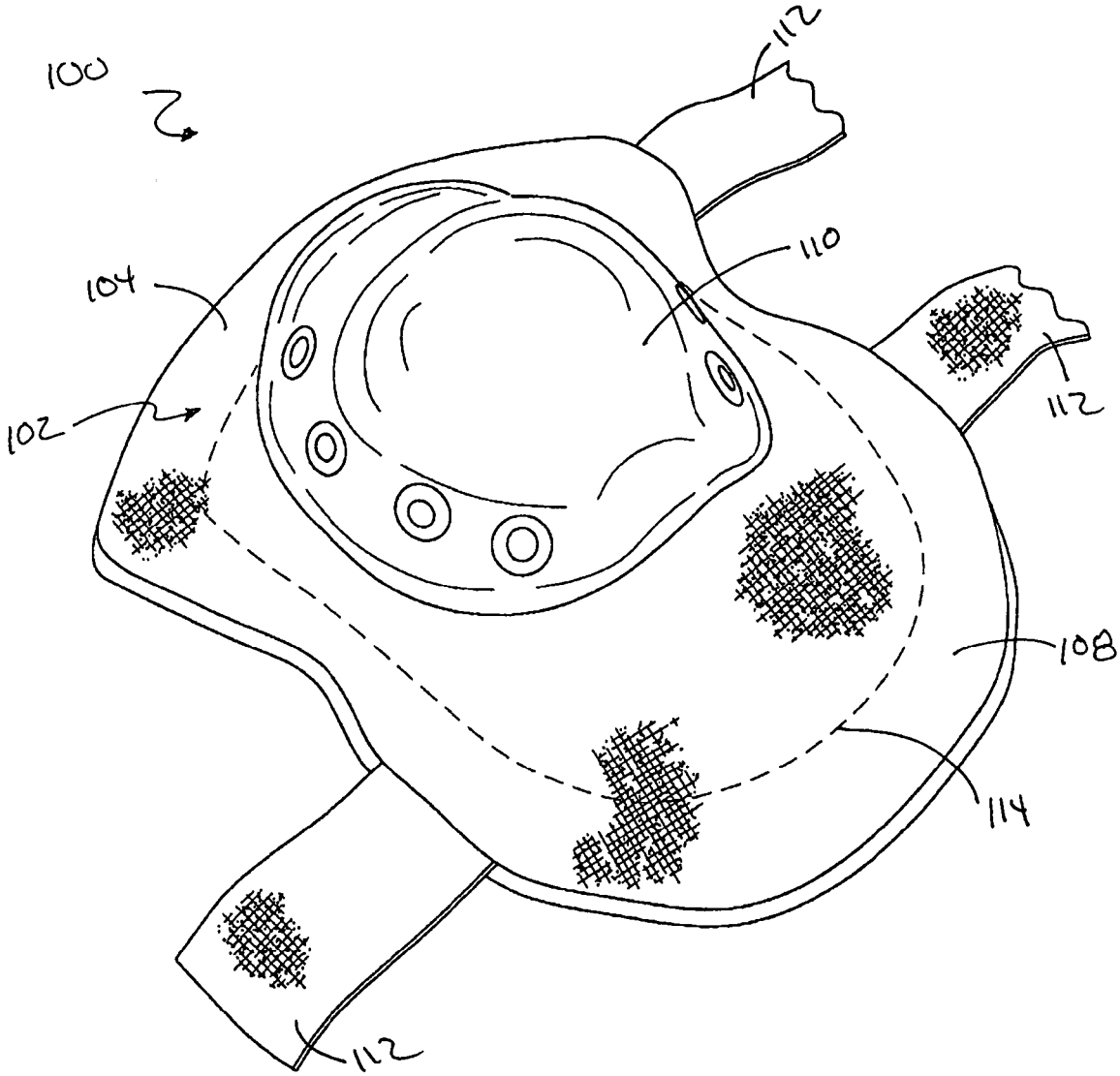
FIG. 1 is a perspective view of the outer surface of a knee pad constructed in accordance with a preferred embodiment of the present invention.
Figure 2:
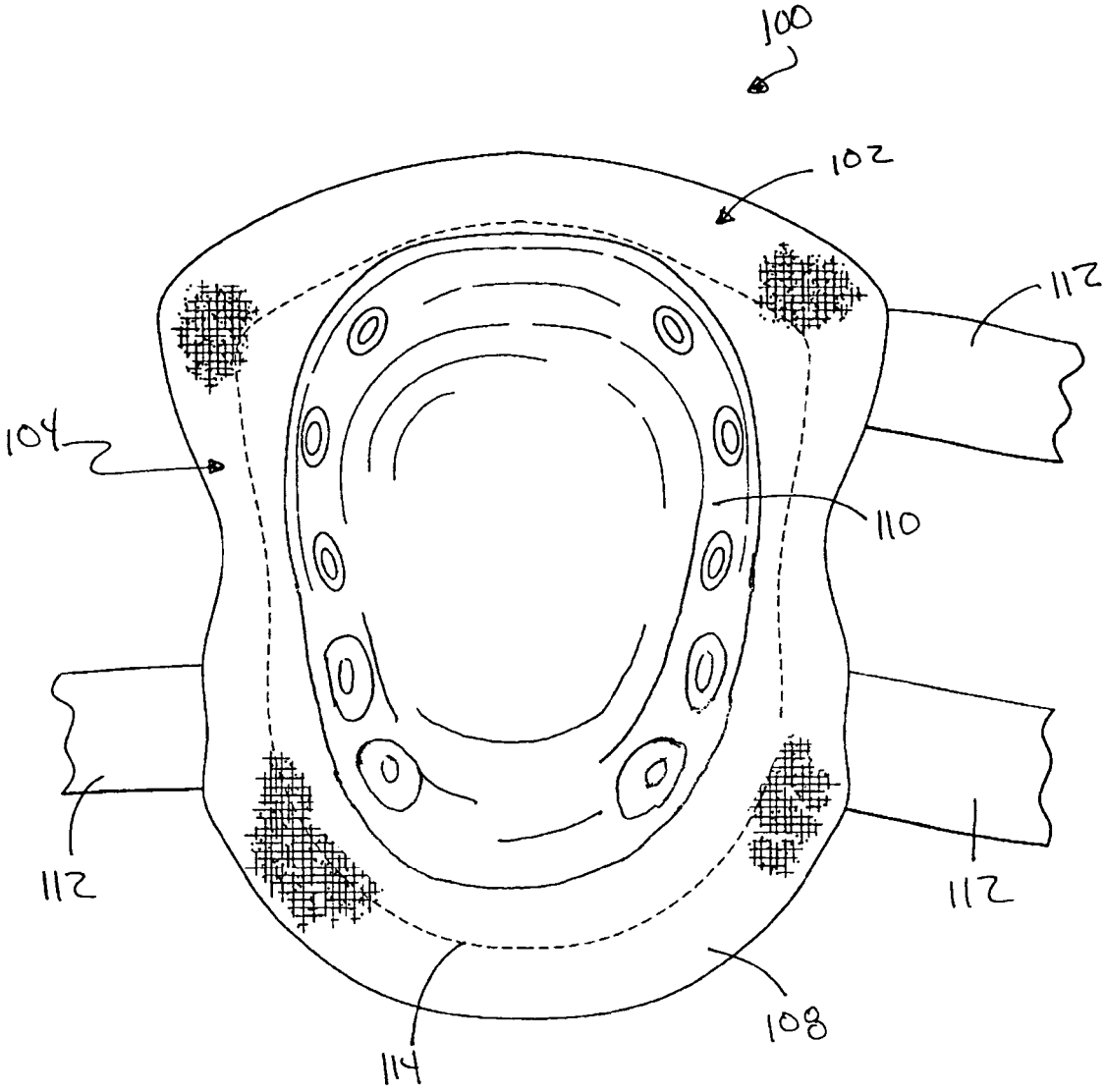
FIG. 2 is a plan view of the outer surface of the knee pad of FIG. 1.

FIGS. 1 and 2 show perspective and plan views, respectively, of a knee pad 100. The knee pad 100 preferably includes a body 102 that includes a generally convex outer side 104 and a generally concave inner side 106. The body 102 generally provides the overall shape and form of the knee pad 100. In a preferred embodiment, the body 102 is fabricated from high-density foam padding, such as ethyl vinyl acetate (EVA). The outer side 104 of the body 102 is preferably encased in a tear-resistant shell 108. The shell 108 is preferably constructed from a durable, wear-resistant fabric such as nylon or polyester. It will be understood that the body 102 can be constructed from alternative materials, such as rubber, textiles or plastic.

The knee pad 100 also includes a cap 110 and one or more fastening devices 112. In the preferred embodiment, the cap 110 is generally oval-shaped and convex. The cap 110 is preferably constructed from a rigid or semi-rigid material, such as hardened plastic, metal or fiberglass and secured to the outer side 104 or shell 108 of the knee pad 100 with stitching, glue or grommets. It will be understood that the cap 110 can be offered in a variety of sizes and shapes to accommodate the needs of specific applications or user-preference. For example, a small cap 110 is shown in FIG. 1 and a large cap 110 is shown in FIG. 2. Alternatively, the cap 110 can be omitted entirely.

The knee pad 100 is preferably secured to the wearer through use of the fastening devices 112. In a particularly preferred embodiment, the fastening devices 112 are constructed from straps and "hook and loop" type fasteners. It will be understood that alternative fastening devices, such as ties, metal clasps, locks or latches could be used alone or in combination with the particularly preferred "hook and loop" type fasteners. Although two fastening devices 112 are shown in FIG. 1, it will be also understood that fewer or additional numbers of fastening devices 112 can be used.

The knee pad 100 optionally includes one or more creases in the body 102. In a particularly preferred embodiment, a crease 114 in the body 102 is disposed across the center of the body 102 under the cap 110. The crease 114 permits the articulation of the knee pad 100 by allowing portions of the knee pad 100 to flex during use. Providing a degree of articulation improves the comfort and fit of the knee pad 100.

Figure 3:
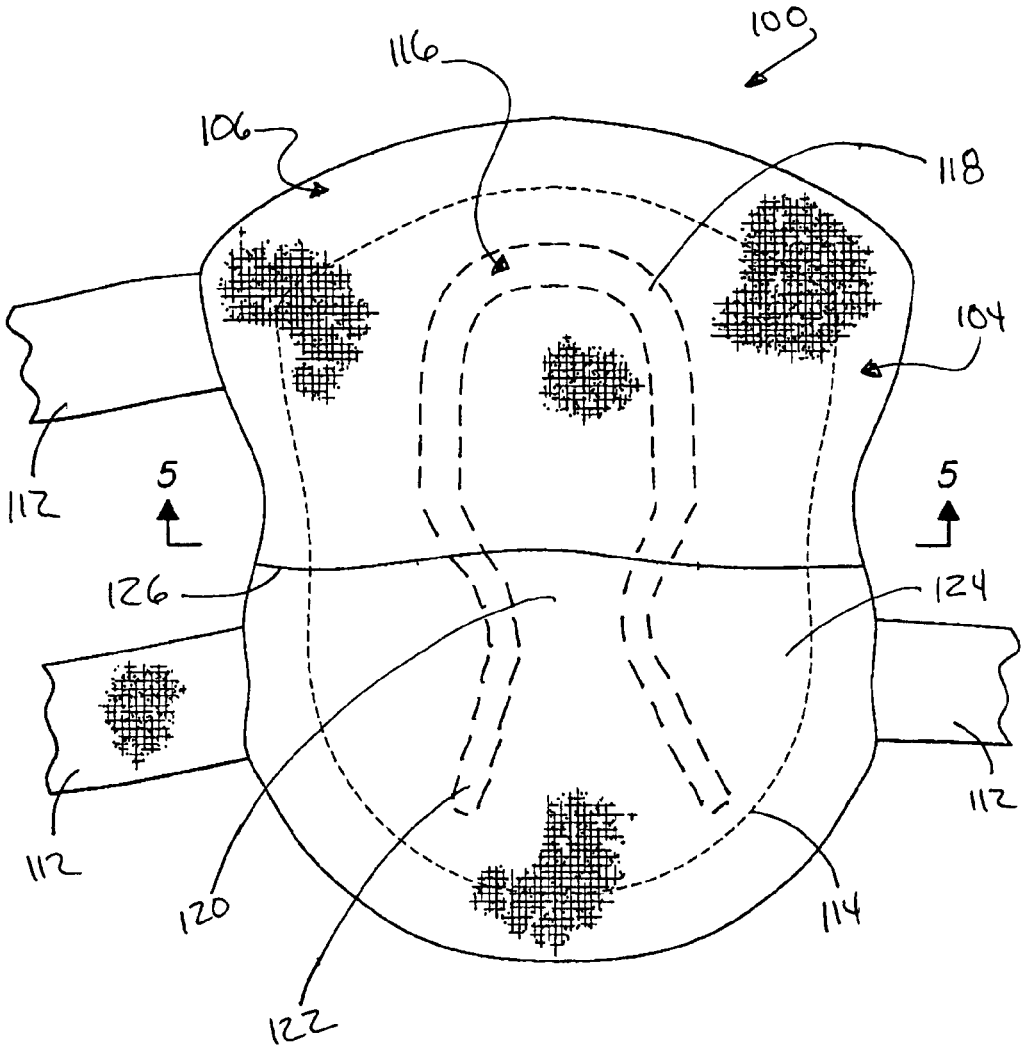
FIG. 3 is a plan view of the inner surface of the knee pad of FIG. 1.
Figure 4:
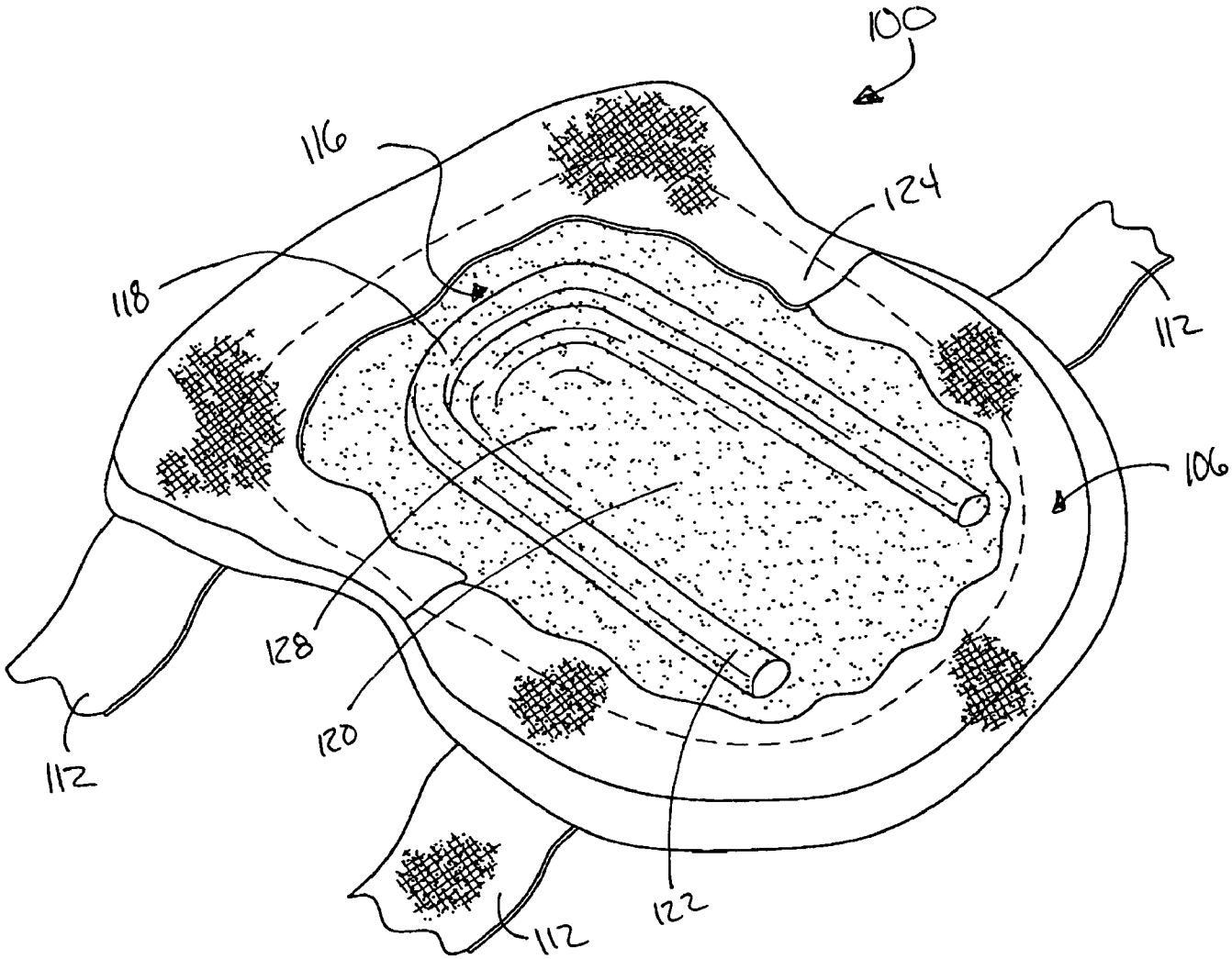
FIG. 4 is a perspective view of the knee pad of FIG. 1.

Turning to FIGS. 3 and 4, shown therein are plan and perspective views, respectively, of an interior of the knee pad 100. In the preferred embodiment, the knee pad 100 includes a patella stabilizer 116 secured to the inner side 106 of the body 102. The patella stabilizer 116 preferably includes a patella support portion 118, a patellar tendon recess 120 and a tibia support portion 122.

In the presently preferred embodiment shown in FIG. 3, the patella stabilizer is generally configured in a "stretched-omega" shape. The patella support portion 118 is generally circular and configured to accept the wearer's patella. The patella stabilizer 116 narrows at the patellar tendon recess 120 to ensure that weight is not applied to the wearer's patellar tendon during use. The wearer's tibia is partially supported as the patella stabilizer 116 widens from the patellar tendon recess 120 to the tibia support portion 122. In the preferred embodiment, the patella stabilizer is constructed from a suitable high-density foam, neoprene, closed-cell or expanded foam. In an alternate embodiment shown in FIG. 4, the patella stabilizer 116 is substantially "U-shaped" with a broader patellar tendon recess 120.

In the presently preferred embodiment, a fabric covering 124 conceals the patella stabilizer 116. The fabric covering 124 is shown in partial cut-away fashion in FIG. 4 to expose the otherwise concealed patella stabilizer 116. The fabric covering 124 is preferably constructed from a comfortable, absorbent, wear-resistant material that is suitable for contact with the wearer's skin. Suitable materials include cotton, polyesters, nylons and blended fabrics. A seam 126 in the fabric covering 124 can be used to provide access to the internal portions of the knee pad 100.

Figure 5:
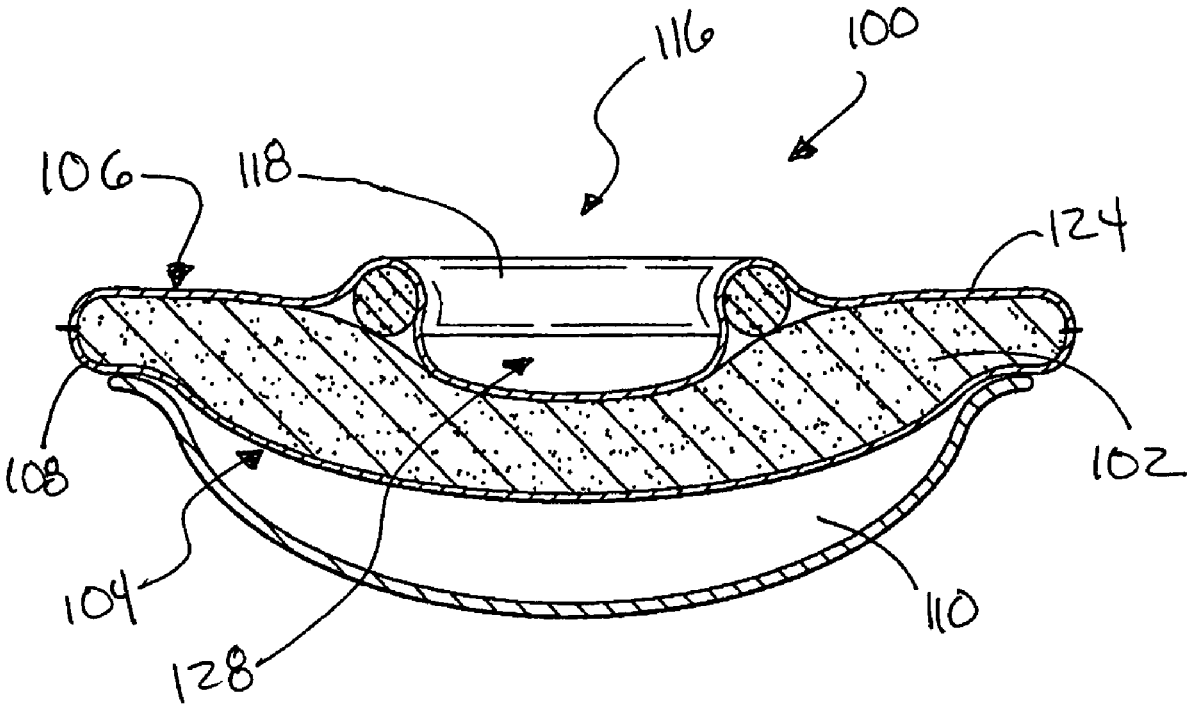
FIG. 5 is a cross-sectional view of the knee pad of FIG. 1.

As most clearly shown in the cross-sectional view of FIG. 5, the body 102 optionally includes a patella recess 128 adjacent the patella support portion 118 of the patella stabilizer 116. The patella recess 128 further cradles the wearer's kneecap and lowers the wearer's knee in the knee pad 100. The patella stabilizer 116 and the patella recess 128 combine to conform to the wearer's knee to provide stabilization without adversely affecting the biometrics of the knee.

In an alternately preferred embodiment, the shape and contour of the patella stabilizer 116 can be adjusted by the end user to conform to the particular shape of the wearer's knee. In this alternate embodiment, the patella stabilizer 116 can be connected to the inner side 106 of the body 102 with a releasable fastener. For example, the inside surface of the body 102 can be fitted with a suitable "loop" fabric and the underside of the patella stabilizer 116 can be fitted with a suitable "hook" fabric. The end user can form the patella stabilizer 116 into a desired shape and then fix the patella stabilizer 116 in the selected shape by pressing the patella stabilizer 116 onto the inner side 106 of the body 102. The selected shape is retained by the hook-and-loop connection between the patella stabilizer 116 and the body 102. The seam 126 can be used to provide access to the inside surface of the body 102 through the fabric covering 124.

In a presently preferred embodiment, the wearer places the knee pad 100 onto her knee and adjusts the fastening devices 112 for a comfortable fit. The patella stabilizer 116 and patella recess 128 cradle the wearer's knee without stressing soft tissue, such as the patellar tendon. The patella stabilizer 116 and patella recess 128 prohibit the knee pad 100 from displacing laterally or vertically on the user's knee thereby ensuring that the knee pad 100 is properly worn and affording the wearer optimal ergonomic protection.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other articles without departing from the scope and spirit of the present invention.

It is claimed:

1. A knee pad comprising:

a body having a generally convex outer side and a generally concave inner side;

a cap secured to the outer side of the body; and a patella stabilizer secured to the inner side of the body, wherein the patella stabilizer comprises a patella support portion, a patellar tendon recess adjacent to the patella support portion, and a tibia support portion adjacent to the patellar tendon recess, wherein the tibia support portion includes two legs extending on opposite sides of the patellar tendon recess.

2. The knee pad of claim 1, wherein the body is constructed from a high-density foam.

3. The knee pad of claim 2, wherein the outer side of the body is encased in a tear-resistant shell and the cap is connected to the tear-resistant shell.

4. The knee pad of claim 1, wherein the body is fabricated from rubber.

5. The knee pad of claim 1, wherein the cap is constructed a rigid plastic material.

6. The knee pad of claim 1, wherein the patella stabilizer is constructed from a material selected from the group consisting of high density foam, neoprene, closed-cell foam and expanded foam.

7. The knee pad of claim 6, wherein the body includes a patella recess adjacent the patella support portion of the patella stabilizer.

8. The knee pad of claim 1, wherein the shape of the patella stabilizer is adjustable.

9. The knee pad of claim 1, wherein the body includes a crease to permit articulation during use.

10. A knee pad comprising:

a body constructed from a high-density foam, wherein the body has a inner side and an outer side; and a patella stabilizer secured to the inner side of the body, wherein the patella stabilizer comprises a patella support portion, a patellar tendon recess adjacent to the patella support portion, and a tibia support portion adjacent to the patellar tendon recess, wherein the tibia support portion includes two legs extending on opposite sides of the patellar tendon recess.

11. The knee pad of claim 10, wherein the inner side is generally concave and the outer side is generally convex.

12. The knee pad of claim 10 further comprising a cap attached to the outer side of the body.

13. The knee pad of claim 12, wherein the outer side of the body is encased in a tear-resistant shell and the cap is attached to the tear-resistant shell.

14. The knee pad of claim 10, wherein the inner side of the body includes a patella recess adjacent the patella support portion of the patella stabilizer.

15. The knee pad of claim 10, wherein the body includes at least one crease to permit the articulation of the knee pad during use.

16. The knee pad of claim 10, wherein the shape of the patella stabilizer generally resembles a "stretched-omega" shape and includes a rounded patella support portion, a narrowed patellar tendon recess portion and a tibia support portion having two extended legs.

17. The knee pad of claim 10, wherein the shape of the patella stabilizer is adjustable.

* * * * *